US009728392B2

(12) United States Patent
Gardner

(10) Patent No.: US 9,728,392 B2
(45) Date of Patent: Aug. 8, 2017

(54) MASS SPECTROMETER ELECTRODE

(71) Applicant: Hamilton Sundstrand Corporation, Charlotte, NC (US)

(72) Inventor: Ben D. Gardner, Colton, CA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 230 days.

(21) Appl. No.: 14/599,968

(22) Filed: Jan. 19, 2015

(65) Prior Publication Data

US 2016/0211129 A1 Jul. 21, 2016

(51) Int. Cl.
*H01J 49/42* (2006.01)
*H01J 49/40* (2006.01)

(52) U.S. Cl.
CPC ..... *H01J 49/4255* (2013.01); *H01J 49/403* (2013.01)

(58) Field of Classification Search
CPC ..... H01J 49/065; H01J 49/067; H01J 9/14
See application file for complete search history.

(56) References Cited

U.S. PATENT DOCUMENTS

RE28,420 E * 5/1975 Murphy ..... H04R 19/01 381/173
5,572,035 A * 11/1996 Franzen ..... H01J 49/065 250/292
5,710,427 A * 1/1998 Schubert ..... H01J 49/424 250/282
6,121,607 A * 9/2000 Whitehouse ..... H01J 49/063 250/282
6,329,654 B1 * 12/2001 Gulcicek ..... H01J 49/063 250/281
6,617,577 B2 * 9/2003 Krutchinsky ..... H01J 49/0481 250/282
6,762,406 B2 * 7/2004 Cooks ..... H01J 49/0013 250/291
7,126,118 B2 * 10/2006 Park ..... H01J 49/063 250/282
7,456,396 B2 * 11/2008 Quarmby ..... H01J 49/427 250/282
8,334,506 B2 * 12/2012 Rafferty ..... H01J 49/26 250/281
8,921,774 B1 * 12/2014 Brown ..... H01J 49/26 250/282
9,396,923 B2 * 7/2016 Kodera ..... H01J 49/424
2013/0175440 A1 * 7/2013 Perelman ..... H01J 49/067 250/288

(Continued)

OTHER PUBLICATIONS

G. Werth, Basics of Ion Traps, Johannes Gutenberg University, 104 pages.

(Continued)

*Primary Examiner* — Joseph L Williams
*Assistant Examiner* — Jose M Diaz
(74) *Attorney, Agent, or Firm* — Kinney & Lange, P.A.

(57) ABSTRACT

A monolithic electrode includes a first portion devoid of apertures and a second portion surrounded by the first portion, the second portion having a web defining a plurality of apertures. A method for forming an electrode includes forming a first electrode portion devoid of apertures and forming a second electrode portion having a web defining a plurality of apertures. The web of the second electrode portion connects to the first electrode portion.

12 Claims, 5 Drawing Sheets

(56) References Cited

U.S. PATENT DOCUMENTS

| | | | | |
|---|---|---|---|---|
| 2015/0170898 | A1* | 6/2015 | Jiang | H01J 49/063 250/282 |
| 2015/0303047 | A1* | 10/2015 | Jiang | H01J 49/4285 250/283 |
| 2016/0071709 | A1* | 3/2016 | Hendricks | H01J 49/0013 250/282 |

OTHER PUBLICATIONS

W.M. Keck Biomedical Mass Spectrometry Lab, Introduction to Mass Spectrometry, Moore Health Sciences Library, May 18, 2010, 54 pages.

* cited by examiner

MASS SPECTROMETER ELECTRODE

BACKGROUND

Mass spectrometry (MS) is an analytical technology used to identify the types and amounts of chemicals present in a sample. This determination is made by measuring the mass-to-charge ratio and abundance of the gas-phase ions generated from a sample. Mass spectrometers generally include three components: an ion source, a mass analyzer and a detector. In a typical MS analysis a portion of a sample is ionized. A wide variety of ionization techniques exist including electron bombardment, chemical ionization, and laser desorption, among others. The ionization process causes some of the sample's molecules to become molecular ions, and some may dissociate into smaller ions representing a portion of the original molecule. The ions thus generated are then separated by the mass analyzer according to their mass-to-charge ratio by subjecting the ions in a controlled manner to either an electric or magnetic field, or a combination of electric and magnetic fields. The ions are ultimately sent to a detector capable of sensing charged particles, such as an electron multiplier. The detector records the charge induced or the current produced as an ion passes by or contacts a surface. Results are displayed as a histogram of the relative abundance of detected ions as a function of their mass-to-charge ratio. Molecules in the sample are then identified by correlating the identified mass-to-charge ratios to chemical structures and through characteristic fragmentation patterns.

Various mass analyzers are used to separate ions, including time-of-flight analyzers, quadrupole analyzers, and ion traps. In each case a critical parameter is the shape and position of the electrodes used to establish the electric fields that control the ions for analysis. In the case of quadrupoles and ion traps the electrodes may include a curved surface that is used to establish a hyperbolic electric field essential to the performance of the analyzer. In the classical quadrupole ion trap, one electrode includes an aperture that allows an electron beam to enter the ion trapping region, and another electrode includes an aperture through which ions exit to the detector. It may also be desirable to include additional apertures to allow for modified operation of the ion trap. Unfortunately, the additional apertures further distort the surface of the endcap electrodes, and consequently the electric field generated by the electrode is non-ideal as well, diminishing the performance characteristics of the analyzer. Similarly, in the time-of-flight analyzer, the electrodes are generally flat plates having large apertures, and the electric field penetrating an aperture from one side of the electrode may adversely affect the electric field on the other side.

Generally the solution for minimizing any electric field distortion is to minimize the size of the aperture. However, limiting the cross section of the aperture also limits the passage of electrons, ions, gas molecules, and light through the aperture. It is possible in time-of-flight analyzers to utilize a large cross-section-area aperture on a planar electrode and add a high-transmission electroform mesh to the electrode surface over the aperture to preserve the electrode planarity. Practically, however, attaching the mesh is cumbersome and it is problematic to attach the mesh to the electrode without causing some distortion of the electrode planarity. For analyzers such as ion traps and quadrupoles, a mesh cannot practically be attached to curved-surface electrodes in a manner that both preserves the intended curvature of the electrode surface over the aperture and retains sufficient structural durability. Electrodes have been made using a woven mesh to provide high optical transmission while enduring some distortion to the electric field due to the irregular electrode surface.

It is desired to develop a method of establishing an aperture of any size in an electrode such that the intended electrode shape is highly conserved and structurally durable. Such a method could yield electrode apertures that are reproducible and allow the addition of apertures that have heretofore been impractical.

SUMMARY

A monolithic electrode includes a first portion devoid of apertures and a second portion surrounded by the first portion. The second portion has a web defining a plurality of apertures.

A method for forming an electrode includes forming a first electrode portion devoid of apertures and forming a second electrode portion having a web defining a plurality of apertures. The web of the second electrode portion connects to the first electrode portion.

DETAILED DESCRIPTION

The present disclosure describes electrodes for use in mass spectrometer mass analyzers. In order to better understand the electrodes disclosed herein, the operation of a mass spectrometer will be briefly summarized.

Figure 1:
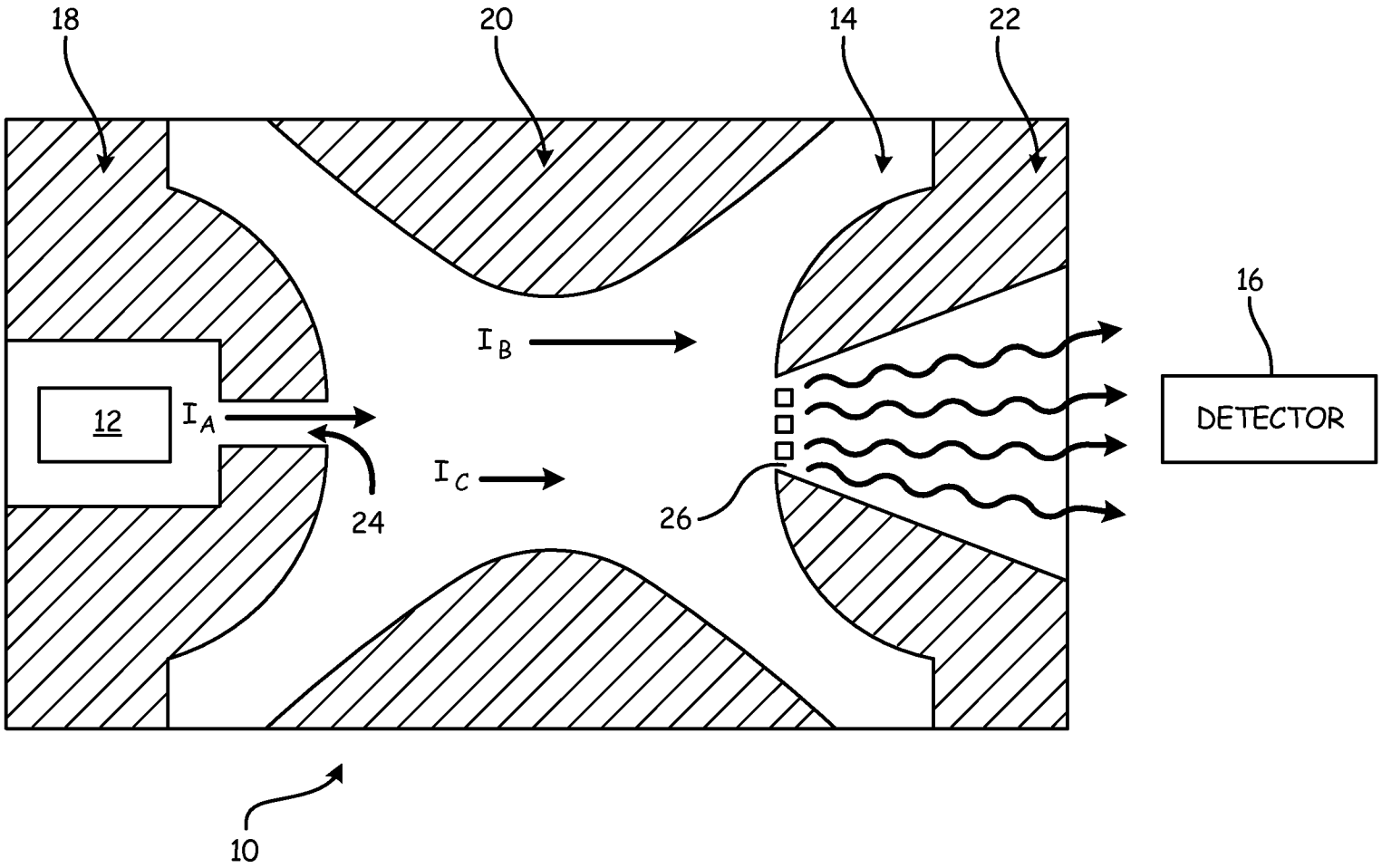
FIG. 1 is a cross section schematic view of an ion trap mass spectrometer.

FIG. 1 illustrates a cross section schematic view of one example of a state of the art ion trap mass spectrometer. Mass spectrometer 10 includes ionizer 12, mass analyzer 14 and detector 16. FIG. 1 emphasizes the contents of mass analyzer 14. Mass analyzer 14 is an electrode assembly that includes entrance end cap electrode 18, ring electrode 20 and exit end cap electrode 22. In use, a vacuum is applied to mass analyzer 14 in order to remove neutral molecules that may collide and hinder the movement of ions within mass analyzer 14. When a voltage is applied to electrodes 18, 20 and 22 of mass analyzer 14, an electric field is generated. This electric field is used to control the movement of ions within mass analyzer 14 so that ions can be separated based on their mass-to-charge ratios. In this embodiment, mass analyzer 14 is an ion trap having two hyperbolic shaped electrodes 18 and 22. While FIG. 1, illustrates mass spectrometer 10 having an ion trap type mass analyzer 14, other types of mass analyzers can be used, including linear ion traps, time-of-flight analyzers and monopole and quadrupole mass analyzers. These other types generally operate by employing the same idea of using electric or magnetic fields to control the movement of ions based on their mass-to-charge ratio.

Electrons $I_A$ from ionizer 12 enter mass analyzer 14 through aperture 24 of entrance end cap electrode 18. In some examples, entrance end cap electrode 18 can include multiple apertures 24. Upon application of an electric field by electrodes 18, 20 and 22, ions $I_A$ are separated into two or more groups based on the mass-to-charge ratios of the different ions that make up $I_A$. For the sake of simple illustration, these ion groups are identified in FIG. 1 as $I_B$ and $I_C$. The ion groups move through mass analyzer 14 towards detector 16. The ion groups are ejected from the trap sequentially according to their mass-to-charge ratio. Ion groups $I_B$ and $I_C$ exit mass analyzer 14 through one or more apertures 26 in exit end cap electrode 22 and proceed to detector 16 where they are quantitatively sensed.

Entrance end cap electrode 18, ring electrode 20 and exit end cap electrode 22 are shaped and configured to provide a specific electric field and electric field gradient (i.e. the distribution of the electric field within mass analyzer 14) when voltage is applied to electrodes 18, 20 and 22. Altering the shape of electrodes 18, 20 and 22 changes the shape of the electric field and the electric field gradient within mass analyzer 14. This includes the formation of apertures 24 in entrance end cap electrode 18 and apertures 26 in exit end cap electrode 22.

Figure 2:
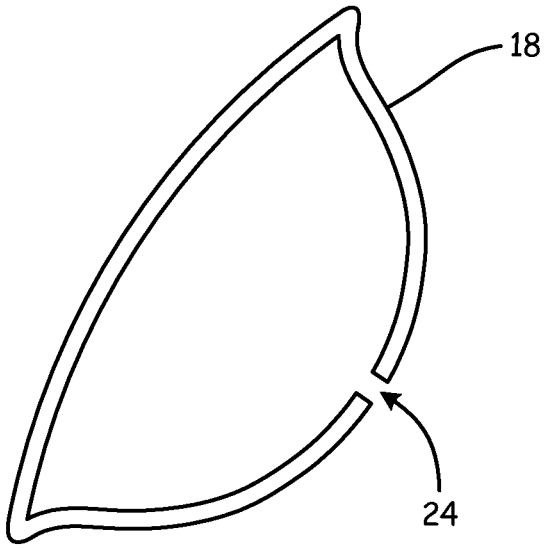
FIG. 2 is a cross section view of a prior art end cap electrode.
Figure 3:
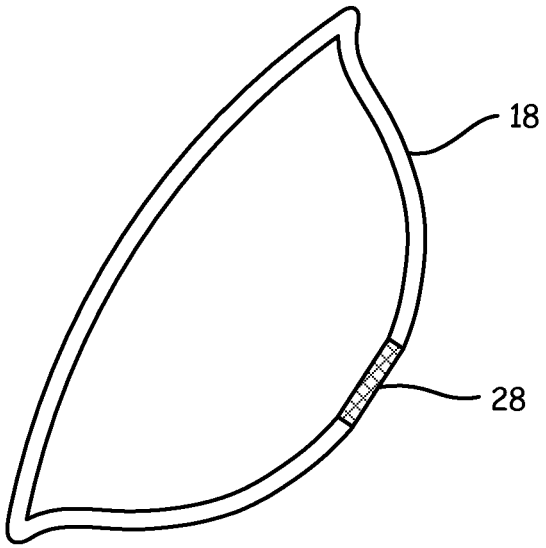
FIG. 3 is a cross section view of a prior art end cap electrode.

FIGS. 2 and 3 show state of the art end cap electrodes used in mass spectrometers. FIG. 2 illustrates a cross section view of a state of the art end cap electrode in which a single aperture 24 is formed in entrance end cap electrode 18 by drilling. In this example, a single aperture 24 is drilled in one end of electrode 18 to facilitate transmission of ions (or electrons, depending on the spectrometer design). However, the material removed from electrode 18 to form aperture 24 distorts the electric field created by electrode 18 when voltage is applied. This distortion to the electric field diminishes analyzer performance.

FIG. 3 illustrates a cross section view of a state of the art end cap electrode in which mesh 28 is located at one end of entrance end cap electrode 18. A portion of electrode 18 is removed and replaced by mesh 28. Mesh 28 is typically a flat, electroformed metal material having a thickness between about 0.025 mm (0.001 inches) and about 0.05 mm (0.002 inches). Mesh 28 is typically spot welded to electrode 18 and contains a number of apertures through which ions and electrons are able to transmit. However, in addition to distorting the electric field of electrode 18, mesh 28 carries other disadvantages. For example, mesh 28 doesn't bend well and is fragile. Welding mesh 28 to electrode 18 is also not very reproducible, yielding electrodes with differently distorted electric fields even when the same materials for mesh 28 and electrode 18 are used. Thus, current state of the art end cap electrodes undesirably distort the electric field of mass analyzer 14.

Electrodes according to the present disclosure reduce the magnitude of electric field distortion when compared to state of the art electrodes. These electrodes also possess more structural integrity than state of the art electrodes and can possess a greater concentration of openings/apertures to allow increased transmission of electrons and/or ions. Because the openings/apertures can be thick in one dimension, they can be thin in an orthogonal dimension, yielding a high optical transmission.

Figure 4:
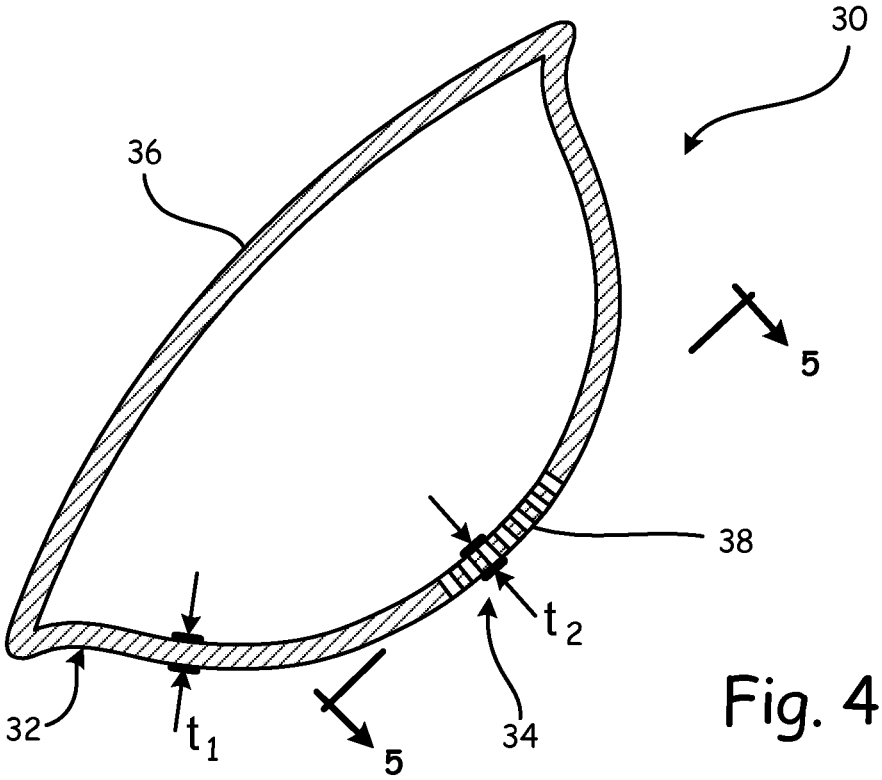
FIG. 4 is a cross section view of one embodiment of an end cap electrode according to the present disclosure.

FIG. 4 illustrates a cross section view of one embodiment of an end cap electrode according to the present disclosure. End cap electrode 30 can have an overall shape similar to those of entrance end cap electrode 18 and exit end cap electrode 22 described above. In the embodiment shown in FIG. 4, end cap electrode 30 has a hyperbolic shape. End cap electrode 30 includes first portion 32 and second portion 34. First portion 32 extends from first terminus 36. Second portion 34 is located proximate second terminus 38, which is generally opposite first terminus 36. As shown in FIG. 4, second terminus 38 represents a vertex of one branch of a hyperbola while first terminus 36 represents the axial extent of the arms of a hyperbola branch. End cap electrode 30 has a greater radial extent at first terminus 36 than at second terminus 38. End cap electrode 30 can function as either an entrance end cap electrode or an exit end cap electrode.

First portion 32 can have a varying or uniform wall thickness. In some embodiments, first portion 32 has an average wall thickness ($t_1$ in FIG. 4) between about 0.25 millimeters (0.010 inches) and about 1.3 millimeters (0.050 inches). First portion 32 is solid and does not contain apertures or openings extending through its wall. First portion 32 extends from first terminus 36 to second portion 34.

Second portion 34 can have a varying or uniform wall thickness. In some embodiments, second portion 34 has an average wall thickness ($t_2$ in FIG. 4) the same as that of first portion 32. In other embodiments, second portion 34 has a wall thickness different from that of first portion 32. In some embodiments, second portion 34 has an average wall thickness between about 0.25 millimeters (0.010 inches) and about 1.3 millimeters (0.050 inches). Unlike first portion 32, second portion 34 contains a web and a plurality of apertures extending through its wall. These apertures allow electrons and/or ions to transmit through second portion 34 and, hence, end cap electrode 30.

Figure 5:
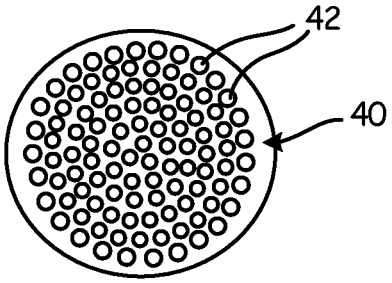
FIG. 5 is a cross section view of the end cap electrode of FIG. 4 taken along the line 5-5.
Figure 6:
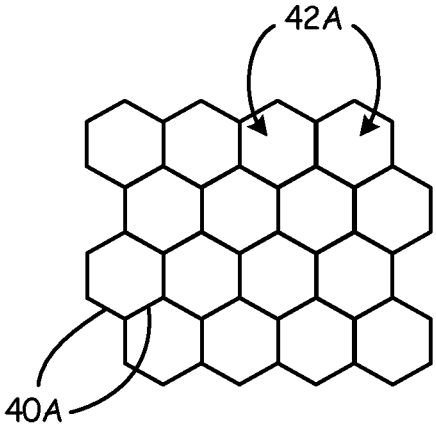
FIG. 6 is a cross section view of another embodiment of an end cap electrode.

FIG. 5 illustrates a cross section view of second portion 34 of end cap electrode 30 taken along the line 5-5 and shows web 40 and a plurality of apertures 42 extending through second portion 34. Web 40 is a series or grid of interconnected bodies that define apertures 42. Web 40 has an axial thickness (i.e. into and out of the page) equivalent to the wall thickness of second portion 34 and a radial body thickness (i.e. the thickness between adjacent apertures as shown in FIG. 5). The radial body thickness of the bodies of web 40 can vary depending on the amount of transmission needed through apertures 42. As apertures 42 become smaller and more numerous, the optical distortion created by second portion 34 increases. In the embodiment shown in FIG. 5, apertures 42 are circular. In other embodiments, second portion 34 provides a honeycomb-like arrangement for increased transmission. FIG. 6 illustrates a partial cross section view of second portion 34A of an end cap electrode where web 40A of second portion 34A forms a honeycomb. In this embodiment, apertures 42A have a hexagonal shape.

Figure 7:
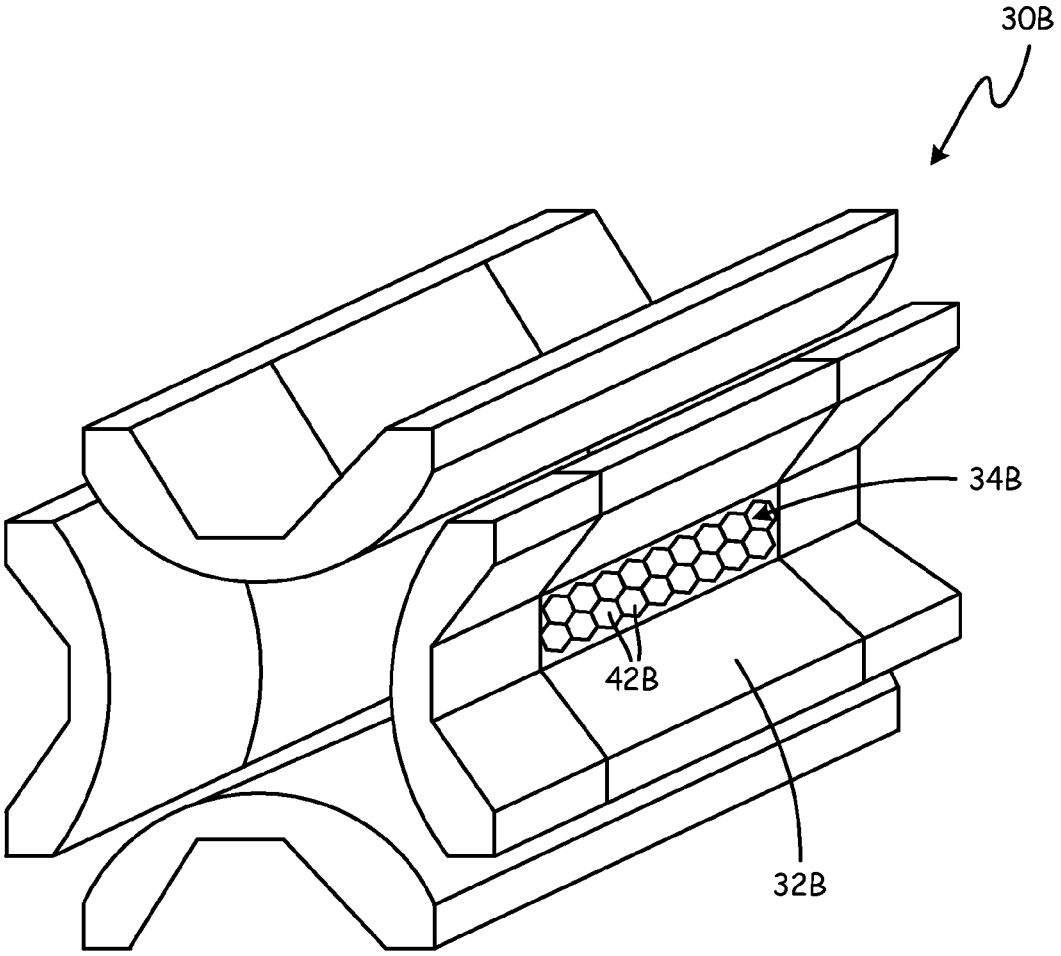
FIG. 7 is a perspective view of one embodiment of a linear ion trap electrode according to the present disclosure.
Figure 8A:
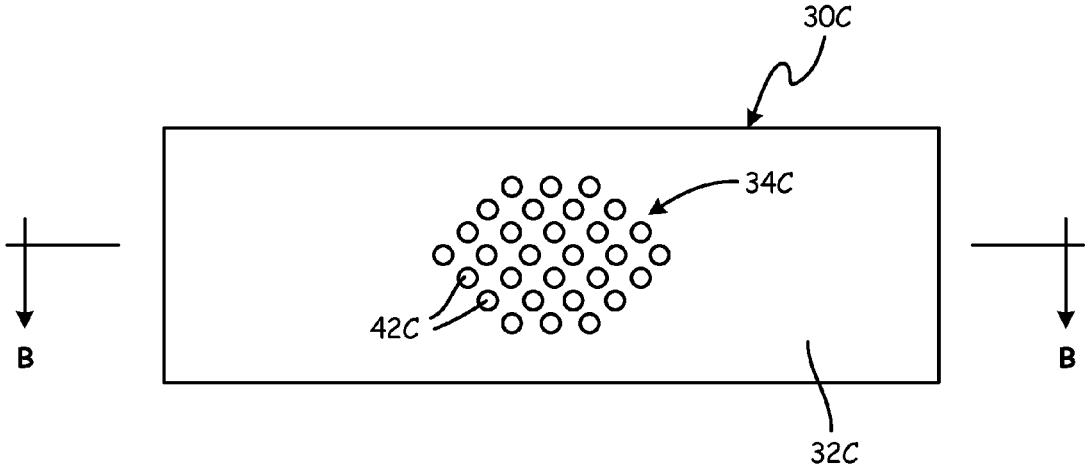
FIG. 8A is a top view of one embodiment of a time-of-flight (TOF) electrode according to the present disclosure.
Figure 8B:
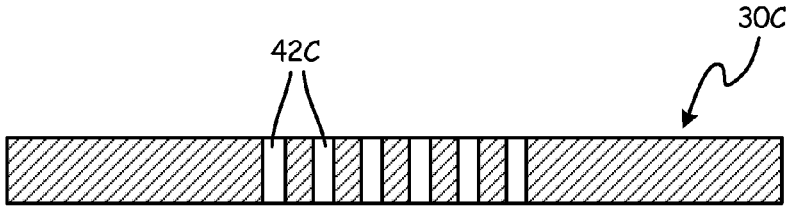
FIG. 8B is a cross section view of the electrode of FIG. 8A.

While FIGS. 3 and 4 illustrate one embodiment of an end cap electrode, electrodes of other types and shapes can also include web 40 and apertures 42. Electrodes can be flat, cylindrical or spherical or take other shapes. For example. FIG. 7 illustrates a perspective view of one embodiment of a linear ion trap electrode. Electrode 30B includes first portion 32B and second portion 34B. Second portion 34B includes apertures 42B similar to those shown in FIG. 6. Apertures 42B allow beams, such as a laser, to be delivered to the ion trap while maintaining the desired electric and/or magnetic field. Apertures 42B are arranged in a slot-like fashion along a central region of electrode 30B. FIGS. 8A and 8B illustrate views of a flat electrode that could be used in a time-of-flight mass spectrometer. Electrode 30C includes first portion 32C and second portion 34C. Second portion 34C includes apertures 42C similar to those shown in FIG. 5. In this embodiment, first portion 32C surrounds second portion 34C.

Due to the capabilities of additive manufacturing, discussed in greater detail herein, apertures 42 and 42A can be as much as ten times smaller than apertures formed by material removal such as drilling (e.g., electrode 18 of FIG. 2).Additive manufacturing is a manufacturing process in which a three-dimensional structure is built layer-by-layer. In some embodiments, an additive manufacturing method is used to build up first and second portions 32 and 34 of end cap electrode 30. Second portion 34 is built so that it includes webs 40 and apertures 42. End cap electrode 30 can be built layer-by-layer using direct metal laser sintering (DMLS), electron beam melting (EBM) or other additive techniques. A three-dimensional model of end cap electrode 30, including web 40 and apertures 42, provides detailed build instructions to an additive manufacturing device. The additive manufacturing device then forms end cap electrode 30 one layer at a time. Additive manufacturing allows the connection of second portion 34 to first portion 32 without the need for additional welds or drilling or other material removal techniques that can adversely affect the electric field generated by end cap electrode 30. Web 40 of second portion 34 can be seamlessly connected directly to first portion 32. End cap electrode 30 can be additively formed of a metal, such as stainless steel or brass, or a plastic or a ceramic that is later coated with a metal. Suitable plastics for forming a metal-coated plastic electrode include polyimides. Suitable ceramics for forming a metal-coated ceramic electrode include aluminum oxides.

Due to the manufacturing capabilities of additive manufacturing, the bodies of web 40 and apertures 42 of second portion 34 can have complex and intricate shapes that cannot be made by conventional drilling and machining techniques. First portion 32 and second portion 34 can form a monolithic end cap electrode 30 (i.e. electrode 30 is formed of a single piece of material without welding or otherwise connecting two components together). In some embodiments, second portion 34 is more "open" than "closed". That is, the hypothetical surface area of second portion 34 contains more void area (from apertures 42) than solid body area (from web 40). Such an arrangement better enables the transmission of electrons and/or ions through second portion 34.

Apertures 42 allow electrons and/or ions to pass through end cap electrodes 30. Web 40 provides structural integrity and helps maintain the shape of the electric field generated by end cap electrode 30. Thus, the size of apertures 42 and the arrangement of web 40, when compared to state of the art electrodes (e.g., electrodes 18 and 22), provide increased structural integrity and reduce distortions to the electric field generated by end cap electrode 30. For example, end cap electrode 30 is stronger than an electrode having a single large aperture at one end (FIG. 2) or an electrode having a mesh portion (FIG. 3). A single large aperture weakens the overall structure of a hyperbolic electrode, and mesh welded to an electrode is fragile. As web 40 seamlessly interconnects second portion 34 to first portion 32, web 40 provides structural integrity to end cap electrode 30. Additionally, the presence of web 40 at an equivalent axial thickness to second portion 34 provides significantly less distortion to the electric field generated by end cap electrode 30. On the other hand, a single large aperture 24 and mesh 28 compromise the electric field of electrode 18 by causing a greater change in the shape of the electrode.

Discussion of Possible Embodiments

The following are non-exclusive descriptions of possible embodiments of the present invention.

A monolithic electrode can include a first portion devoid of apertures and a second portion surrounded by the first portion, the second portion having a web defining a plurality of apertures.

The electrode of the preceding paragraph can optionally include, additionally and/or alternatively, any one or more of the following features, configurations and/or additional components:

A further embodiment of the foregoing electrode can include that the first portion and the second portion have substantially equal wall thicknesses.

A further embodiment of any of the foregoing electrodes can include that the electrode has a hyperbolic shape, and the electrode has a first end and a second end generally opposite the first end, and the first portion extends from the first end and the second portion is located at the second end.

A further embodiment of any of the foregoing electrodes can include that the second portion has an average wall thickness between about 0.25 millimeters (0.010 inches) and about 1.3 millimeters (0.050 inches).

A further embodiment of any of the foregoing electrodes can include that the second portion has a surface area, and wherein a majority of the surface area comprises apertures.

A further embodiment of any of the foregoing electrodes can include that the first and second portions are formed from a material selected from the group consisting of metals, metal-coated plastics and metal-coated ceramics.

A further embodiment of any of the foregoing electrodes can include that the first and second portions are formed from stainless steel or brass.

A further embodiment of any of the foregoing electrodes can include that the apertures have circular shapes.

A further embodiment of any of the foregoing electrodes can include that the electrode is selected from the group consisting of ring electrodes, flat plate electrodes, linear ion trap electrodes, monopole electrodes and quadrupole electrodes.

A further embodiment of any of the foregoing electrodes can include that the web of the second portion forms a honeycomb arrangement and the apertures have hexagonal shapes.

A method for forming an electrode can include forming a first electrode portion devoid of apertures and forming a second electrode portion having a web defining a plurality of apertures where the web of the second electrode portion connects to the first electrode portion.

The method of the preceding paragraph can optionally include, additionally and/or alternatively, any one or more of the following features, configurations and/or additional components:

A further embodiment of the foregoing method can include that the apertures are formed by a process other than removing material from the second portion web.

A further embodiment of any of the foregoing methods can include that the first and second portions are formed by additive manufacturing.

A further embodiment of any of the foregoing methods can include that the first and second portions are formed from one type of material.

A further embodiment of any of the foregoing methods can include that the first and second portions are formed from a plastic or a ceramic, and further comprising coating the first and second portions with a metal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment(s) disclosed, but that the invention will include all embodiments falling within the scope of the appended claims.

The invention claimed is:

1. A monolithic electrode comprising:

a first portion devoid of apertures; and a second portion surrounded by the first portion, the second portion having a web defining a plurality of apertures;

wherein the first portion and the second portion have substantially equal wall thicknesses; and wherein the electrode has a hyperbolic shape, and wherein the electrode has a first end and a second end generally opposite the first end, and wherein the first portion extends from the first end and the second portion is located at the second end.

2. The electrode of claim 1, wherein the second portion has an average wall thickness between about 0.25 millimeters (0.010 inches) and about 1.3 millimeters (0.050 inches).

3. The electrode of claim 1, wherein the second portion has a surface area, and wherein a majority of the surface area comprises apertures.

4. The electrode of claim 1, wherein the first and second portions are formed from a material selected from the group consisting of metals, metal-coated plastics and metal-coated ceramics.

5. The electrode of claim 1, wherein the first and second portions are formed from stainless steel or brass.

6. The electrode of claim 1, wherein the apertures have circular shapes.

7. The electrode of claim 1, wherein the electrode is selected from the group consisting of ring electrodes, flat plate electrodes, linear ion trap electrodes, monopole electrodes and quadrupole electrodes.

8. The electrode of claim 1, wherein the web of the second portion forms a honeycomb arrangement, and wherein the apertures have hexagonal shapes.

9. A method for forming an electrode, the method comprising:

forming a first electrode portion devoid of apertures; and forming a second electrode portion having a web defining a plurality of apertures, wherein the web of the second electrode portion connects to the first electrode portion;

wherein the apertures are formed by a process other than removing material from the second portion web.

10. The method of claim 9, wherein the first and second portions are formed by additive manufacturing.

11. The method of claim 9, wherein the first and second portions are formed from one type of material.

12. The method of claim 9, wherein the first and second portions are formed from a plastic or a ceramic, and further comprising coating the first and second portions with a metal.

* * * * *